United States Patent [19]

Mirto, Jr.

[11] 3,974,654

[45] Aug. 17, 1976

[54] SELF-REGULATING TIDE GATE

[75] Inventor: Matthew Mirto, Jr., Stratford, Conn.

[73] Assignee: W. S. Rockwell Company, Fairfield, Conn.

[22] Filed: Oct. 28, 1975

[21] Appl. No.: 625,861

[52] U.S. Cl. ..... 61/17; 61/25; 61/26; 61/27; 137/409; 137/448

[51] Int. Cl.[2] ..... E02B 7/40

[58] Field of Search ..... 61/17, 18, 19, 22, 23, 61/25, 26, 27, 29, 12; 137/448, 429, 426, 409

[56] References Cited

UNITED STATES PATENTS

| | | | |
|---|---|---|---|
| 243,030 | 6/1881 | Wright | 61/27 |
| 1,139,104 | 5/1915 | Collar | 61/26 |
| 1,692,127 | 11/1928 | Keon | 61/17 |
| 2,206,363 | 7/1940 | Murphy | 137/448 X |

*Primary Examiner*—Jacob Shapiro
*Attorney, Agent, or Firm*—Smythe & Moore

[57] ABSTRACT

A self-regulating device for controlling the flow of water from a conduit open end into a reservoir or wet marshland and to an outside body of water, such as tidal water, which includes a gate pivotally mounted at its bottom edge so as to be pivotable upwardly to close the conduit end. A rod is pivotally connected to the upper edge of the gate and extends upwardly through a slotted bracket, and a float is mounted on the upper portion of the rod above the bracket. As the level of the tidal water rises, the float will rise and move the gate into the closed position.

12 Claims, 4 Drawing Figures

SELF-REGULATING TIDE GATE

The present invention relates to a device for controlling the flow of water from a conduit open end into a wet marshland and, more particularly, to a self-regulating tide gate which will close the conduit when the tidal water rises to a predetermined level.

In many areas of the country, steps have been taken for the preservation of tidal wetlands which are generally in the form of salt marsh acreage along the coast. In many areas portions of the wetlands have been filled for residential, land-fill, and industrial purposes, and other portions have been diked and drained for tidal flood hazard reduction. One proposal for the restoration of the marshes was to remove any cross-channel dikes which may have been constructed across the marshlands and to rebuild the dikes around the periphery of the marsh. This would simultaneously preserve tidal flood protection to the areas while still providing for natural tidal action to flush the marshes. However, since adjacent to such marsh areas, there are often found residential subdivisions, some of which may be built no higher than four feet above the marsh surface, any efforts toward restoration of the marshes could not proceed until tidal flood protection was provided while also restoring tidal action in the marshes.

To control the flow of water through the dikes surrounding the marshes, it is necessary to provide some form of a tide gate mounted on the down-stream, or tidal side, of a conduit passing through the dike. A known form of a tide gate is hinged on the top to prevent salt water intrusion while providing for a discharge of any fresh water resulting from upland runoff. While relatively simple in construction, this gravity gate requires periodic maintenance and repair to insure proper functioning.

Other forms of tide gates were known but were intended to exclude all tidal action from a dike marsh.

It is the object of the present invention to provide a relatively simple and inexpensive tidal flow device which would permit full tidal flow through a dike but which would stop this flow automatically at a predetermined water level to avoid tidal flooding.

Another object is to provide such a tide gate which could operate continuously, efficiently, and dependably under varied and adverse climatic conditions, such as the effects of winter ice, seaweed, floating debris, and powerful water currents.

According to one aspect of the present invention, a device for controlling the flow of water from a conduit open end into a wetland or reservoir may comprise a flow control gate which is pivotally mounted at its lower edge upon a horizontal axis in the vicinity of the bottom of the conduit opening. The gate is pivotable upwardly against the conduit opening to a closed position. A bracket extends from above the conduit and has a slot therein which is substantially parallel to the longitudinal axis of the conduit. A rod is pivotally connected to the top of the gate and extends upwardly through the bracket slot. A float is positioned on the rod above the bracket such that, as the level of water in the tidal body rises, the float will rise to pivot the gate upwardly toward the closed position.

This gate control device has been found to be an effective tidal gate which requires very little maintenance and can be readily repaired. In addition, this gate can be closed manually in the event of an advanced storm warning when reserved water volumes are necessary in order to reduce storm sewer flooding in the areas adjacent the marsh.

Other objects, advantages and features of the present invention will become apparent from the accompanying description and drawings, which are merely exemplary.

In the drawings.

Proceeding next to the drawings wherein like reference symbols indicate the same parts throughout the various views, a specific embodiment of the present invention will be described in detail.

Figure 1:
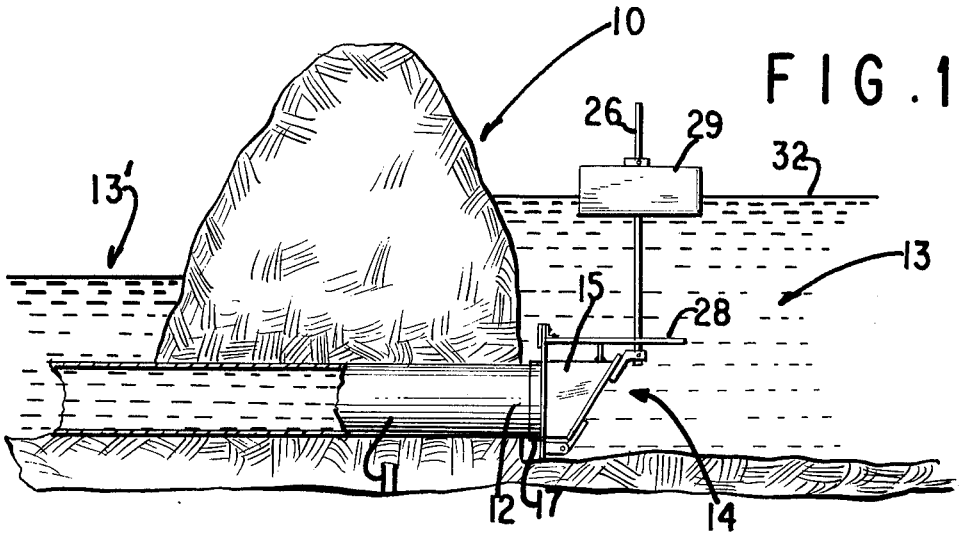
FIG. 1 is a vertical sectional view through a dike through which passes a conduit on the end of which is mounted the tidal gate according to the present invention.
Figure 2:
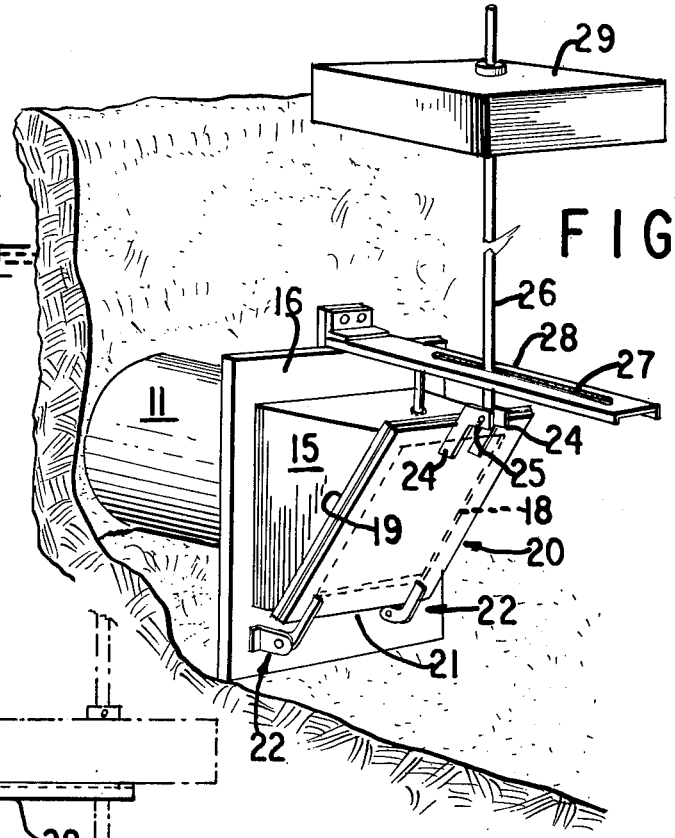
FIG. 2 is a perspective view looking at the tidal gate when in the closed position.

In FIG. 1, there is illustrated at 10 a cross section of a flood control dike through which extends a conduit 11 having an open end 12 opening into the tidal body of water 13. Attached to the conduit open end 12 is the flow control device according to the present invention and indicated generally at 14.

The flow control device 14 comprises a tubular connection 15 which has a substantially square or rectangular cross section extending from a flange or base 16 on the other side of which extends a socket 17 which fits over the open end 12 of the conduit. The socket 17 and tubular connection 15 may be made of suitable metals and attached to the flange or base plate 16 by means of welding or other processes.

Figure 3:
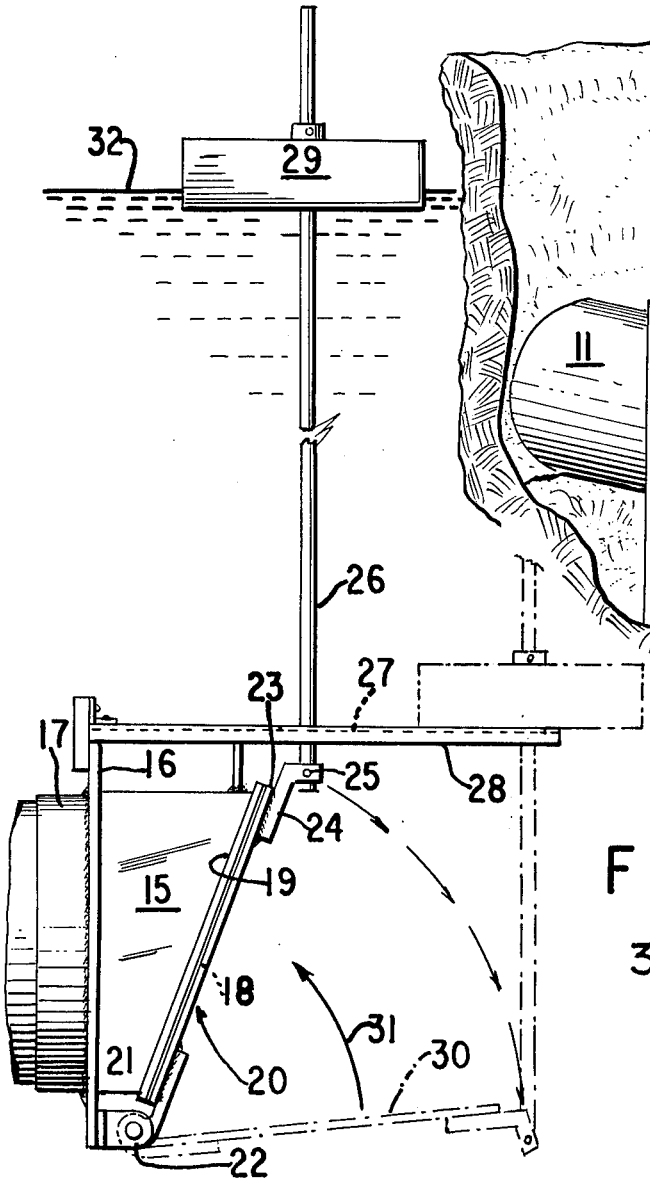
FIG. 3 is a side elevational view in enlarged scale of the tidal gate shown in FIG. 1 and showing the open and closed positions of the gate.

The tubular connection 15 has its opening 18 inclined at an angle from the vertical as can be seen in FIG. 3 and is provided with an external flange 19. A flow control gate 20 is pivotally mounted at its bottom edge 21 by means of a pair of hinges 22 positioned on the bracket or base plate 16 such that the pivot axis of the gate 20 is along a horizontal axis which is below the conduit and perpendicular to the longitudinal axis of the conduit.

Adjacent to the upper edge 23 of the gate 20 is mounted a bracket 24 to which is pivotally connected the lower end of a vertically extending rod 25 by a pin 26. The rod 26 extends upwardly through a horizontal slot 27 formed in a bracket 28 extending horizontally outwardly from the upper portion of the base plate 16 in substantially the direction of the longitudinal axis of the conduit.

Adjacent to the upper end of the rod 26 is mounted a float 29 whose position on the rod 26 can be adjusted so as to control the level to which the water can rise before closing the gate.

In the drawings, the control gate 20 is shown in its closed position but its open position is indicated by the dashed lines 30 in FIG. 3. The gate is gravity operated so that the gate will automatically be opened as the water level drops.

When the gate is open, as shown in 30 in FIG. 3, the rod 26 will be in a position at the right hand end of the slot 27 as shown in FIG. 3. As water flows through conduit 11 into the reservoir or marsh 13, the rising level of water will cause float 29 to rise. As the float rises, the gate 20 will be pivoted upwardly from its open position 30 in the direction of the arrow 31 toward its closed position as shown by the solid lines in FIG. 3. During this upward movement of the float and gate, the rod 26 will be moving toward the left in the slot 27, as viewed in FIG. 3. When the water rises to a level 32 as shown in FIGS. 1 and 3, the gate will be in its closed position.

Figure 4:
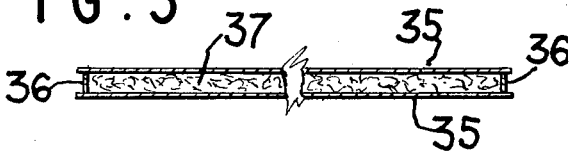
FIG. 4 is a sectional view through a modified form of the gate.

In a preferred form, the gate or leaf can be made as seen in FIG. 4. Face plates 35, 35 can be separated by spacer bars 36 forming a box-like structure. These parts can be joined by welding. The interior space then can be filled with a light material, such as poly urethane foam. The foam will prevent water filling the space through leakage.

Rod 26 can have an antifriction material placed thereon. Merely as an example, a nylon coating could be used.

It is, therefore, apparent that the present invention has disclosed a self-regulating tidal gate for controlling the flow of water from a conduit open end into a reservoir or marsh. Further, this tidal gate is simple in construction, reliable in operation, and is capable of long operating periods with a minimum of maintenance. Further, the gate will function under adverse climatic conditions and in the presence of debris or seaweed in the water.

It will be understood that various details of construction and arrangement of parts may be made without departing from the spirit of the invention except as defined in the appended claims.

What is claimed is:

1. A device for controlling the flow of water from a conduit open end into a wet marshland or the like and comprising a flow-controlling gate pivotally mounted at its bottom edge upon a horizontal axis in the vicinity of the bottom of the conduit open end, said gate being pivotable upwardly against the conduit opening to a closed position, a bracket extending from above the conduit and having a slot substantially parallel to the longitudinal axis of the conduit, a rod pivotally connected to said gate and extending upwardly through said bracket slot, and a float on said rod above said bracket such that as the level of water adjacent the conduit open end and outside thereof rises, the float will rise to pivot said gate upwardly toward its closed position.

2. A device as claimed in claim 1 wherein said bracket extends horizontally from above the open end of the conduit.

3. A device as claimed in claim 1 wherein said rod is substantially vertical.

4. A device as claimed in claim 3 wherein the lower end of said rod is connected to the top of said gate.

5. A device as claimed in claim 1 and further comprising a tubular connection on the conduit open end.

6. A device as claimed in claim 5 wherein said tubular connection has an open end which is inclined from the vertical.

7. A device as claimed in claim 5 wherein said gate is pivotally mounted on said tubular connection.

8. A device as claimed in claim 5 wherein said bracket extends from said tubular connection.

9. A device as claimed in claim 1 wherein said gate is hollow with the bottom filled with a light material.

10. A device as claimed in claim 9 wherein the light material is poly urethane foam.

11. A device as claimed in claim 1 wherein there is an antifriction material between the walls of said slot and said rod.

12. A device as claimed in claim 11 wherein said rod has a nylon coating.

* * * * *